United States Patent [19]

Kodama et al.

[11] Patent Number: 4,624,224

[45] Date of Patent: Nov. 25, 1986

[54] HYDRAULIC VALVE LIFTER

[75] Inventors: Hisashi Kodama, Nagoya; Takuro Ono, Chiryu, both of Japan

[73] Assignee: Aisin Seiki Kabushiki Kaisha, Kariya, Japan

[21] Appl. No.: 643,935

[22] Filed: Aug. 24, 1984

[30] Foreign Application Priority Data

Aug. 24, 1983 [JP] Japan ..... 58-154365

[51] Int. Cl.[4] ..... F01L 1/24

[52] U.S. Cl. ..... 123/90.46; 123/90.55

[58] Field of Search ..... 123/90.12, 90.39, 90.45, 123/90.46, 90.48, 90.52, 90.55, 90.56

[56] References Cited

U.S. PATENT DOCUMENTS 4,192,263 3/1980 Kitagawa et al. ..... 123/90.39
4,373,477 2/1983 Buente et al. ..... 123/90.46

FOREIGN PATENT DOCUMENTS 2652154 5/1978 Fed. Rep. of Germany ... 123/90.46
3118466 11/1982 Fed. Rep. of Germany ... 123/90.39
0016112 2/1978 Japan ..... 123/90.46

*Primary Examiner*—Craig R. Feinberg
*Assistant Examiner*—David A. Okonsky
*Attorney, Agent, or Firm*—Sughrue, Mion, Zinn, Macpeak, and Seas

[57] ABSTRACT

A hydraulic valve lifter is mounted in a rocker arm of a valve train assembly of internal combustion engines. The lifter includes a cylinder formed in the rocker arm, a plunger reciprocably mounted in the cylinder, a seat member securely pressed in the cylinder above the plunger and provided with an outer circumferential portion extending in a direction of the plunger, a stopper surface formed at an end surface of the outer circumferential portion for restricting an axial movement of the plunger in a direction of the seat member, and a relief recessed area formed above the stopper surface for finishing machining process of the cylinder.

4 Claims, 1 Drawing Figure

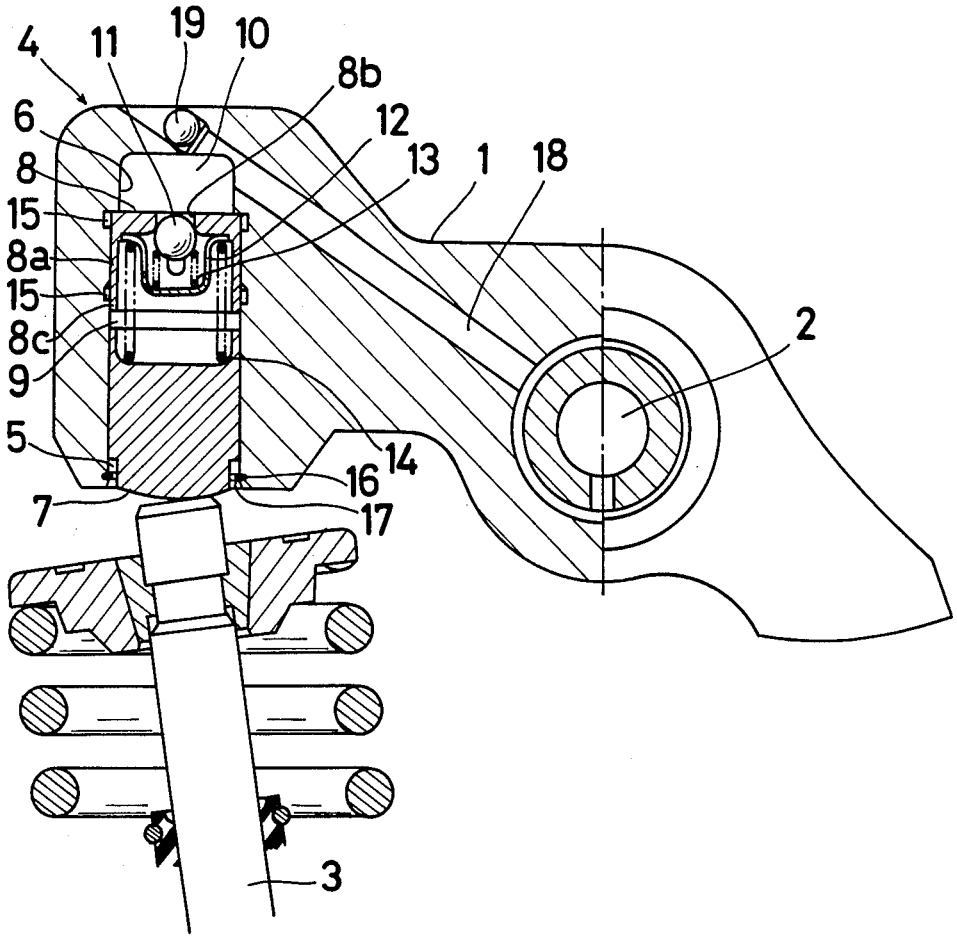
4
11
19
10
8b
6
12
13
1
18
8
15
8a
15
8c
9
2
5
14
16
7
17
3

HYDRAULIC VALVE LIFTER

BACKGROUND OF THE INVENTION

1. Field of the Invention

This invention relates to hydraulic valve lifters as used in internal combustion engines in general, and more particularly to a hydraulic valve lifter mounted in a rocker arm of a valve train assembly of the internal combustion engines.

2. Prior Art of the Invention

An example of a conventional hydraulic valve lifter of this type is disclosed in the Japanese patent laid open application No. 51 (1976) -89951. The above lifter includes a plunger reciprocably mounted in a cylinder formed in a rocker arm. Since a relief recess portion for a finishing machining process of the cylinder is positioned below a plunger stopper, a sliding portion of the plunger will be defined to be short. Therefore, a leak passage formed between the cylinder and the plunger will be defined to be short, an operating performance of the lifter will be deteriorated, and then noises and errors of a valve operating will be produced. In order to eliminate the above disadvantages, there has been proposed a method which diminishes an engaging clearance between the cylinder and the plunger by means of a precise machining process. However, due to the small clearance, the plunger will lack a smooth sliding movement, and then the cost of the machining process becomes very expensive.

In another conventional lifter wherein a stopper portion receiving a plunger is integrally formed in the rocker arm in a unitary body, the plunger will collide with the stopper portion when air is introduced into a pressure chamber. Accordingly, it may be difficult to secure the durability of the stopper portion.

SUMMARY OF THE INVENTION

An object of the present invention is to eliminate the disadvantages of prior art hydraulic valve lifters.

More particularly it an object of the present invention to provide a hydraulic valve lifter wherein the relief recess portion for the machining process of the cylinder is positioned above the plunger stopper, namely above a sliding portion of the plunger.

Another object of the present invention is to provide a new and improved hydraulic valve lifter wherein the operating performance and the durability can be improved.

In one illustrative embodiment of the present invention, there is provided a hydraulic valve lifter which includes a seat member securely pressed in a cylinder formed in a rocker arm, thereby defining a pressure chamber and a reservoir chamber in the cylinder. The lifter further includes a check valve which permits hydraulic flow from the reservoir chamber to the pressure chamber in co-operation with the seat member. The seat member is provided with an outer circumferential portion extending downwardly in the direction of the plunger so that the lower end of the outer circumferential portion may function as a stopper portion for the plunger. Therefore, the upward sliding movement of the plunger is restricted by the lower end of the outer circumferential portion of the seat member positioned below the relief portion for the finishing machining process of the cylinder.

In accordance with one feature of the present invention, in certain particularly advantageous embodiments, the sliding portion of the plunger can be defined to be long. Since the outer circumferential portion of the seat member extends in the direction of the plunger, a large pressed surface of the seat member can be secured when the seat member is pressed in the cylinder of the rocker arm, thereby improving the cylinder sealing function between the cylinder and the seat member.

In accordance with another feature of the present invention, since the seat member can be made of a material with a high wear resistance such as a carburized material, the durability of the stopper portion can be secured even if the seat member is mounted in a casting rocker arm.

The above noted as well as further objects and features of the invention will be understood more clearly and fully from the following detailed description of a preferred embodiment thereof, when read with reference to the accompanying drawing.

DESCRIPTION OF THE DRAWING

The drawing shows a sectional view of a hydraulic valve lifter, mounted in a valve train assembly of internal combustion engines, constructed in accordance with one illustrative embodiment of the invention.

DESCRIPTION OF THE PREFERRED EMBODIMENT

Referring now to the drawing, a rocker arm 1 rocking on a rocker arm shaft 2 receives a load from a cam member (not shown) at one end thereof, and is operatively connected with a valve stem 3 at the other end thereof through a hydraulic valve lifter 4 according to the present invention.

The rocker arm is provided with cylinder 5 and 6 in the side of the engagement with the valve stem 3. The cylinder 5 has an open end facing downward, and the cylinder 6 communicates with the cylinder 5. A plunger or piston 7 is reciprocably mounted in the cylinder 5 thereby closing the open end thereof. An lower end surface of the plunger 7 is in engagement with an upper end surface of the valve stem 3. A seat member 8 is securely pressed in an inner wall surface of the cylinder 5 so that the seat member may be positioned above the plunger 7, thereby defining a pressure chamber 9 in the cylinder 5 and a reservoir chamber 10 in the cylinder 6. The seat member 8 is made of a material with a high wear resistance, and is provided with an outer circumferential portion 8*a* extending downward in the direction of the plunger 7 and provided with a coaxial passageway 8*b* establishing a fluid communication between the pressure chamber 9 and the reservoir chamber 10.

A ball check valve 11 located in the passageway 8*b* is constantly biased toward the seat member 8 by a relatively light coil spring 13 supported by a retainer member 12, thereby permitting a fluid flow from the reservoir chamber 10 to the pressure chamber 9. Interposed in the pressure chamber 9 is a return coil spring 14 which is supported by the retainer member 12 at one end thereof and biases the plunger 7 toward the engagement with the valve stem 3 at the other end thereof.

The outer crcumferential portion 8*a* of the seat member 8 is provided with a lower end surface 8*c* which functions as a stopper restricting an upward movement of the plunger 7. The cylinder 5 is provided with relief recessed areas 15 positioned above the lower end surface 8*c*. The relief areas 15 are formed for finishing machining process of the cylinder 5. An annular recessed area 16 is formed in the cylinder 5 to receive a snap ring 17 thereon restricting an axial movement of the plunger 7 in a downward direction.

The rocker arm 1 is further provided with a passageway 18 to supply hydraulic fluid to the reservoir chamber 10. The open end of the passageway 18 is sealed by a ball plug 19.

It will be obvious to those skilled in the art that various changes may be made without departing from the spirit of the invention and therefore the invention is not limited to what is shown in the drawing and described in the specification, but only as indicated in the appended claims.

What is claimed is:

1. A hydraulic valve lifter mounted in a rocker arm of a valve train assembly of internal combustion engines, said lifter comprising:

a cylinder having a cylindrical surface formed in said rocker arm;

a plunger reciprocably mounted in said cylinder in sliding contact with said cylindrical surface;

a seat member securely pressed in said cylinder above said plunger, said seat member defining a reservoir chamber and a pressure chamber in said cylinder and having an outer circumferential portion extending in contact with said cylindrical surface in a direction of said plunger;

a stopper means formed at an end surface of said outer circumferential portion of said seat member for restricting an axial movement of said plunger in a direction of said seat member; and at least one relief recess means formed in said cylindrical surface above said stopper means for a finishing machining process of said cylinder whereby each recess means is completely covered by said outer circumferential portion of said seat member such that said cylindrical surface encircles said plunger and is formed by an uninterupted smooth sliding surface along the entire length of movement of said plunger.

2. A hydraulic valve lifter according to claim 1 wherein said seat member is made of a material having a high wear resistance.

3. A hydraulic valve lifter according to claim 1 wherein said seat member is provided with a coaxial passageway establishing a hydraulic fluid communication between said reservoir chamber and said pressure chamber.

4. A hydraulic valve lifter according to claim 3 additionally including a check valve located in said coaxial passageway for permitting a hydraulic fluid flow from said reservoir chamber to said pressure chamber.

* * * * *